US005446432A

United States Patent [19]

Ikeuchi

[11] Patent Number: 5,446,432

[45] Date of Patent: Aug. 29, 1995

[54] SADDLE TYPE DEFLECTION COIL

[75] Inventor: Hiroshi Ikeuchi, Kyoto, Japan

[73] Assignee: Murata Mfg. Co., Ltd., Kyoto, Japan

[21] Appl. No.: 371,465

[22] Filed: Jan. 11, 1995

Related U.S. Application Data

[63] Continuation of Ser. No. 21,810, Feb. 24, 1993, abandoned.

[30] Foreign Application Priority Data

Feb. 24, 1992 [JP] Japan ..... 4-072925

[51] Int. Cl.[6] ..... H01H 1/00; G09G 1/04; H01J 29/74

[52] U.S. Cl. ..... 335/213; 315/368.25; 313/433

[58] Field of Search ..... 335/210, 213; 313/343, 313/421, 433; 315/368.25, 364

[56] References Cited

U.S. PATENT DOCUMENTS

| | | | |
|---|---|---|---|
| 3,707,628 | 12/1972 | Bassett | 250/49.5 PE |
| 3,710,289 | 1/1973 | Pax et al. . | |
| 3,750,718 | 8/1973 | Sedgewick | 140/92.1 |
| 4,152,685 | 5/1979 | Renders et al. . | |
| 4,337,219 | 6/1982 | Falkowski | 264/130 |
| 4,464,643 | 8/1984 | Meershoek . | |
| 4,692,731 | 9/1987 | Osinga | 335/299 |
| 4,814,731 | 3/1989 | Sato | 335/216 |

FOREIGN PATENT DOCUMENTS

| | | |
|---|---|---|
| 601730 | 5/1985 | Japan . |
| 61-104543 | 9/1986 | Japan . |

*Primary Examiner*—Leo P. Picard
*Assistant Examiner*—Stephen T. Ryan
*Attorney, Agent, or Firm*—Helfgott & Karas

[57] ABSTRACT

A saddle type deflection coil assembly is formed of a plurality of conductor wires which are not displaced and biassed. A resulted multicore parallel conductor wire is thus not twisted. The deflection coil assembly includes an external coil constructed by winding the plurality of parallel conductor wires in a laminated manner in a continuous groove of a first winding mold. An internal coil is constructed by winding a plurality of parallel conductor wires in a laminated manner in a continuous groove formed in a second winding mold. The internal coil is superimposed on the external coil to form a saddle configuration. A starting end of the external coil and a terminating end of the internal coil are interconnected with each other to form the deflection coil.

9 Claims, 7 Drawing Sheets

SADDLE TYPE DEFLECTION COIL

This is a continuation of application Ser. No. 08/021,810, filed Feb. 24, 1993 is now abandoned.

BACKGROUND OF THE INVENTION

1. Field of the Invention

The present invention relates to a saddle type deflection coil of a deflection yoke mounted on a television receivers and display devices, etc.

2. Description of the Prior Art

With recent development of television receivers to application to those of hi-vision and with recent appearance of highly fine display devices, specifications of color mismatching on a screen of a cathode-ray tube of those devices, i.e., convergence of the same gets increasingly severe, and accompanied therewith further accurate control of a deflection magnetic field becomes earnestly desired.

One type of deflection yokes for use in television receivers and display devices, etc., includes as conventionally known a horizontal deflection coil mounted inside a resin-made bobbin and a vertical deflection coil mounted outside the same. A horizontal deflection coil of a deflection yoke of this type using a bobbin is of a saddle type and a vertical deflection coil is of a saddle type or of a toroidal type.

Referring to FIG. 1, there is illustrated a saddle type deflection coil for use in general deflection yokes in an exemplified manner. In the illustrated saddle type deflection coil 1, a bonding agent is applied on the outer periphery of a winding 11 composed of a conductor wire (including a Litz wire) covered with an insulating layer 4, and the winding 11 is wound in a coil winding groove 5 with the aid of a metal mold 2 having a flange 3, as illustrated in FIG. 2. The winding 11 is constructed by winding separate independent single wires, not bundled in every group of wire thereof using an automated machine. In succession, the coil so wound is supplied with electric power to heat and melt the bonding agent applied on the outside of the insulating agent applied on the outside of the insulating layer 4 for bonding of the wiring in itself, and then, the coil is separated from the metal mold 2 for formation of such a deflection coil as illustrated in FIG. 1. The resulting saddle type deflection coil 1 is complicated in its configuration for accurate control of an associated magnetic field distribution. The metal mold 2 serving to form the deflection coil therefore includes a plurality of winding grooves 5 formed successively therein. An intersecting region where the winding 11 traverses from one groove 5 to the other separate groove is shaped into a wider one region to permit the winding 11 to traverse to the next groove 5 with ease.

The prior art winding method described above however, suffers from the following difficulties: Owing to a change in the direction of tension when the wiring 11 being wound is displaced as illustrated in FIG. 2, and the order of the winding of the winding 11 is changed such winding as designated by a design becomes impossible. Further, a displaced state of each of windings 11 of the mass-produced deflection coils 1 causes variations thereof for each article, which makes it impossible to accurately control a deflection magnetic field. Further, variations in mass-produced articles cause lowering of the yield, and hence the prior art winding method is disadvantageous. Even in the afore-described prior art system, the wiring 11 is reduced and biassed winding as the width of the coil winding groove is narrowed to satisfy an original design, which causes another problem of coil performance because of a ratio L/R between inductance L and resistance R is reduced. To solve the problems with the aforementioned prior art, the present inventors have proposed a method wherein, instead of the prior art winding 11 comprising independent and separate single wires, there are employed and wound multicore parallel conductor wires 15 as illustrated in FIGS. 3 through 5. Such a multicore parallel conductor wire 15 is formed into various forms using a conductor wire 8 (including a Litz wire and a square wire) which is covered with an insulating layer 4. The width of parallel conductor wire 15 is set to be substantially comparable with the width of the coil winding groove 5 of the metal mold 2. In FIG. 3, a multicore parallel conductor wire 15 is constructed by parallel arranging of a plurality of conductor wires 8 and applying a bonding agent 6 to the lower halves of those wires 8 for bonding. In FIG. 4, a multicore parallel conductor wire 15 is constructed by applying a bonding agent 6 on one surface of a resin sheet 7 and bonding parallely-arranged conductor wires 8 to the one surface of the resin sheet 7. Further, in FIG. 5, a multicore parallel conductor wire. 15 is constructed by uniformly applying a bonding agent 6 over the entire surface of the external circumference of conductor wires 8 is parallel and arranging the conductor wires 8 for bonding between adjacent conductor wires 8.

In the just-mentioned prior art example proposed by the present inventors, upon formation of a saddle type deflection coil 1 of a complicated configuration, the prior art metal mold 2 of FIG. 2 is employed and the foregoing multicore parallel conductor wire 15 is wound in a continuous groove 5 in the metal mold 2 to form the deflection coil. Thereupon, such a deflection coil encounters a problem that the multicore parallel conductor wire 15 is twisted in a winding area of an intersection part 9 where the wire traverses from one groove to another separate groove as has been mentioned above. The prior art winding 11 does not suffer from such a problem because a single wire is freely movable in the intersection part 9, while the multicore parallel conductor wire 15 is inevitably twisted because it is restricted in the form of a band.

Additionally, the intersection part is configured to be wider, so that the multicore parallel conductor 15 is freed widthwise in the wider groove and is displaced in the same direction. Such twist and displacement make it difficult to accurately control a deflection magnetic field, and hence even the use of the multicore parallel conductor wire does not improve the performance of the deflection coil.

SUMMARY OF THE INVENTION

It is an object of the present invention is to solve the problems of the prior art and with the prior art example proposed by the present inventors, and the present invention provides a saddle type deflection coil wherein conductor wires are not displaced and biassed upon being wound as well and the multicore parallel conductor wire is not twisted upon being wound.

To achieve the above object, the saddle type deflection coil according to the present invention is adapted such that a muticore parallel conductor wire is wound in a continuous groove of a first winding mold to form an external coil of the saddle type deflection coil to be wound while a multicore parallel conductor wire is wound in a continuous groove of a second winding mold type to form an internal coil of the saddle type deflection coil, said internal coil being superimposed on said external coil into a saddle configuration. For the coil winding molds there are employed two winding molds of.

The above and other objects, features and advantages of the present invention will become more apparent from the following description when taken in conjunction with the accompanying drawings in which preferred embodiments of the present invention are shown by way of illustrative examples.

DETAILED DESCRIPTION OF THE PREFERRED EMBODIMENT

In the following, a preferred embodiment of the present invention will be described with reference to the accompanying drawings. The identical symbols shall be applied to identical elements of the embodiments described by.

Figure 7:
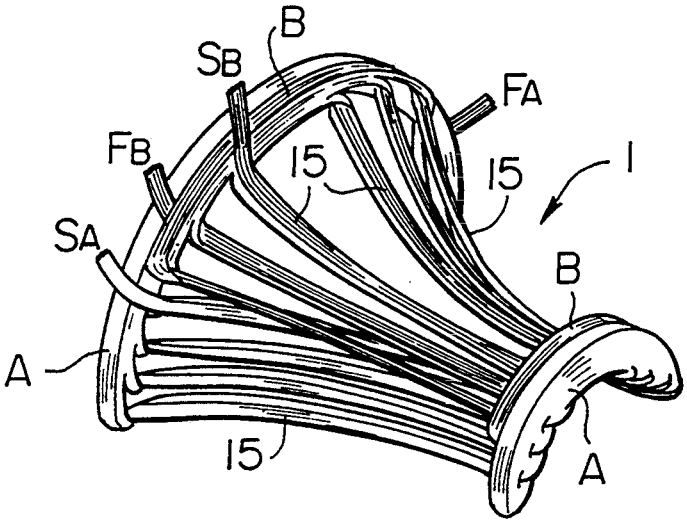
FIG. 7 is a perspective view of a saddle type deflection coil according to the present invention.

Referring now to FIG. 7, there is illustrated an embodiment of a saddle type deflection coil according to the present invention. The present embodiment is characterized in that first and second winding molds are employed as winding molds for the saddle type deflection coil, and multicore parallel conductor wire is wound in continuous grooves of the first and second winding molds to respectively form partial coils of the saddle type deflection coil and superimpose those partial coils into a final saddle type coil.

Figure 8:
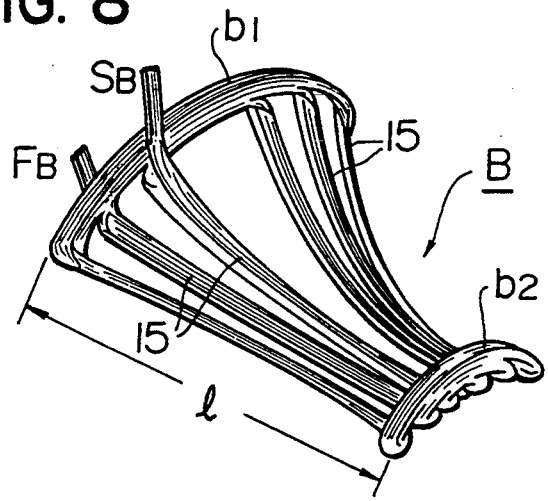
FIG. 8 is a perspective view of an internal coil which constitutes a part of the saddle type deflection coil of FIG. 7.
Figure 9:
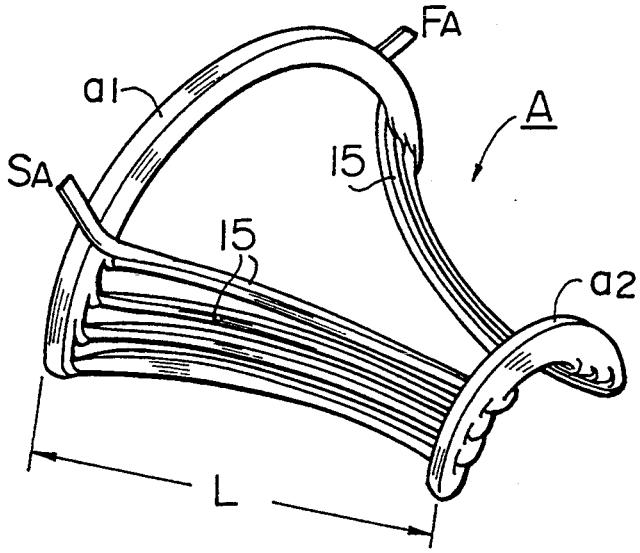
FIG. 9 is a perspective view of an external coil constituting a part of the saddle type deflection coil FIG. 7.

The saddle type deflection coil 1 according to the present invention comprises a smaller internal partial coil B as illustrated in detail in FIG. 8 and a larger external partial coil A as illustrated in detail in FIG. 9. The smaller partial coil B is superimposed on the larger partial coil A.

Figure 10:
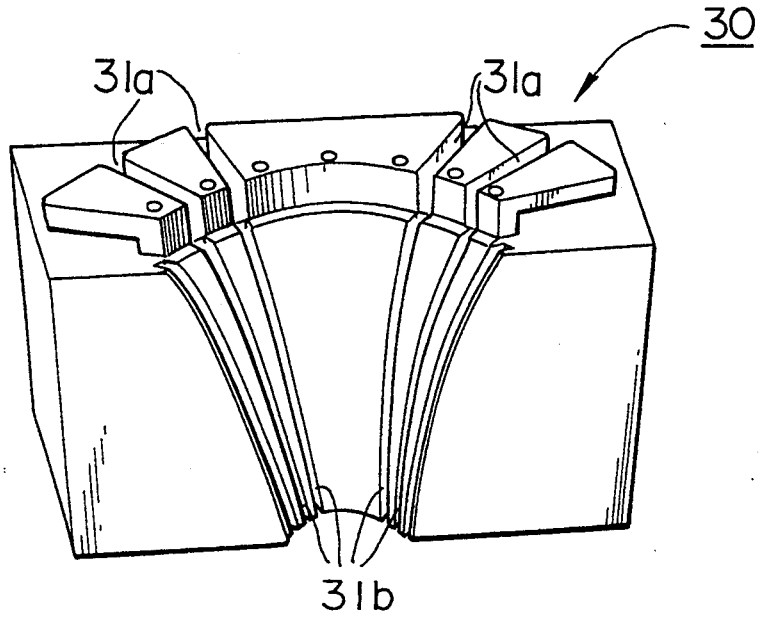
FIG. 10 is a perspective view of a winding mold for use in the manufacture of the internal coil.
Figure 11:
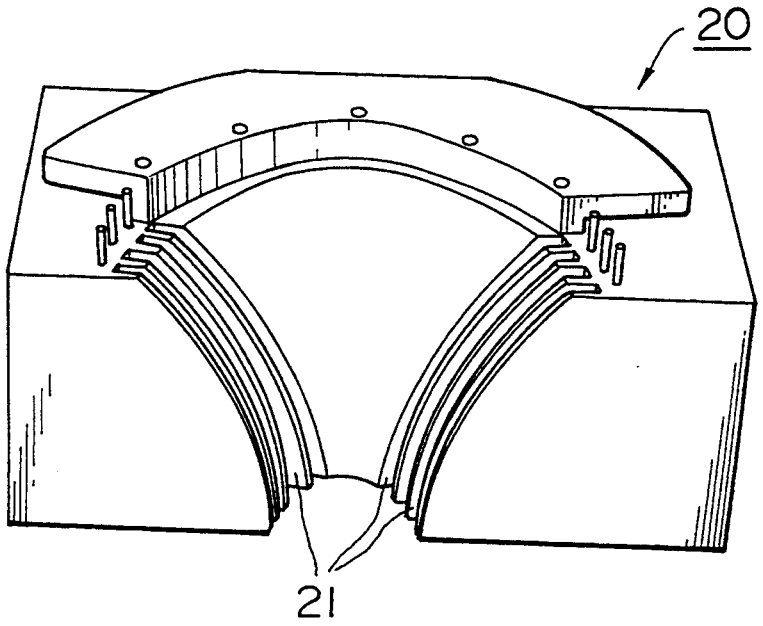
FIG. 11 is a perspective view of a winding mold for use in the manufacture of the external coil.
Figure 12A:
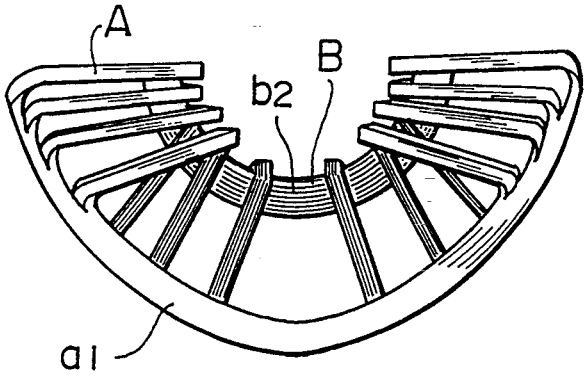
FIG. 12A is a front view of the saddle type deflection coil according to the present invention.
Figure 12B:
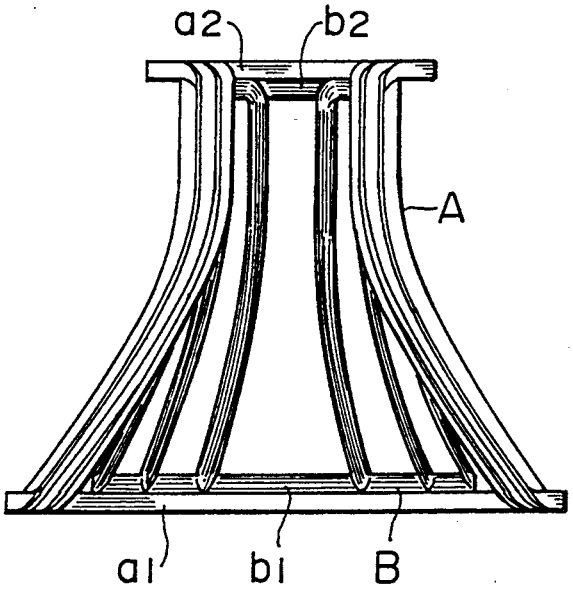
FIG. 12B is a plan view of the saddle type deflection coil of FIG. 12A.
Figure 12C:
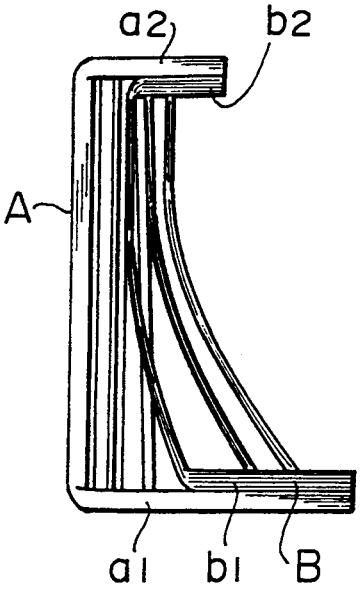
FIG. 12C is a side view of the saddle type deflection coil of FIG. 12A.

The external partial coil A of the saddle type deflection coil having bent portions $a_1$ and as at opposite ends thereof and illustrated in FIG. 9 is formed by winding a multicore parallel conductor wire 15 in a laminated manner in a continuous groove 21 of a first winding mold 20 illustrated in FIG. 11 and bonding respective layers of the multicore parallel conductor wires 15 to each other. Further, the internal partial coil B of the saddle type deflection coil having bent portions bz and bz at opposite ends thereof and illustrated in FIG. 8 is formed by winding the multicore parallel conductor wire 15 in a laminated manner in continuous grooves 31*a* and 31*b* of a second winding mold 30 illustrated in FIG. 10. The entire length 1 of the internal partial coil B is set to be shorter than that L of the external partial coil A, whereby both partial coils A and B are mechanically stably and accurately superimposed one on the other.

As understood from FIG. 8 the internal partial coil B has its winding starting end $S_B$ and its winding terminating end $F_B$, both extending therefrom, while as illustrated in FIG. 9 the external partial coil A has its winding starting end SA and its winding termination end FA both extending therefrom. The winding starting end SA of the external partial coil A and the winding terminating end $F_B$ of the internal partial coil B are electrically interconnected through soldering after both partial coils A and B are superimposed on each other at a subsequent assembly process. The winding terminating end $F_A$ of the external partial coil A and the winding starting end $S_B$ of the internal partial coil B are left behind as they are shown in FIG. 7, and are connected with an external circuit in a subsequent process.

Layers of the respective partial coils A and B are bonded together with resin and hereby stabilized in their configuration and are sometimes bonded and fixed after, being aligned in their relative positions with the use of a jig. Further, resin is casted between the partial coils A and B and is cured. In order to prevent the withstand voltage property of the saddle type deflection coil from being lowered and further prevent any ringing due to resonance from being produced, an area of a superimposed portion between the partial coils A and B is reduced to the utmost. The internal partial coil B is superimposed on the external partial coil A and is accurately fitted in the latter coil A to complete the saddle configuration. The winding starting end of the partial coil A and the winding terminating end of the partial coil B are interconnected in a following process to complete the saddle type deflection coil.

According to the present embodiment, two winding molds i.e. the first and the second winding molds 20 and 30 are employed as coil winding molds, and the multicore parallel conductor wire is wound in the continuous grooves 21 and 31*a* and 31*b* in the first and the second winding molds, so that the intersection part 9 as described in connection with FIG. 6A and the prior art becomes unnecessary without causing the multicore parallel conductor wires 15 to be twisted and displaced in the grooves, and hence a saddle type deflection coil with excellent indimensional accuracy is ensured.

Figure 1:
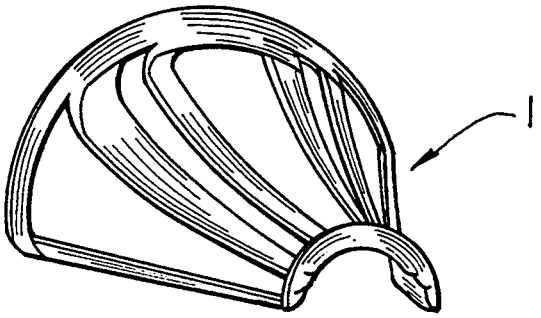
FIG. 1 PRIOR ART
FIG. 1 is a perspective view illustrating a saddle type deflection coil of a general type.
Figure 2:
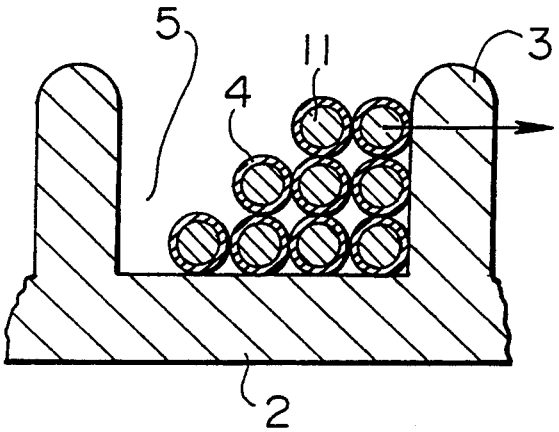
FIG. 2 PRIOR ART
FIG. 2 is a simplified .sectional view illustrating a primary portion of a coil winding metal mold for a prior art deflection coil.
Figure 3:
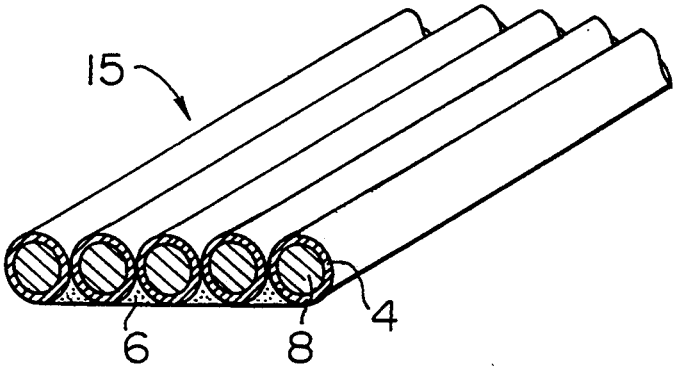
FIG. 3 is a perspective view illustrating a multicore parallel conductor wire of a saddle type deflection coil associated with the example proposed by the inventor and with the present invention.
Figure 4:
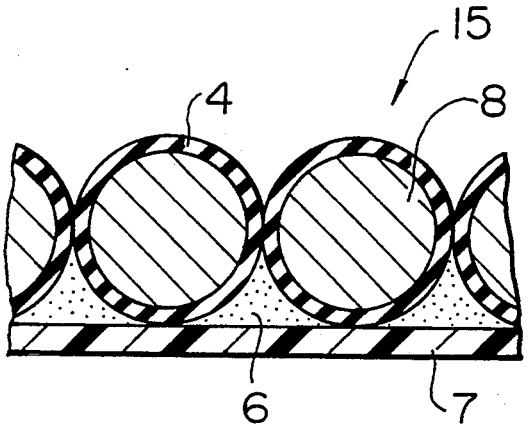
FIG. 4 is a sectional view illustrating a multicore parallel conductor wire of another configuration of the saddle type deflection coil of FIG.3.
Figure 5:
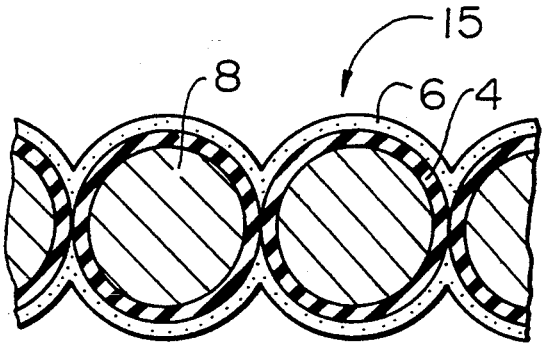
FIG. 5 is a sectional view illustrating a multicore parallel conductor wire of further configuration of the saddle type deflection coil of FIG.3.
Figure 6A:
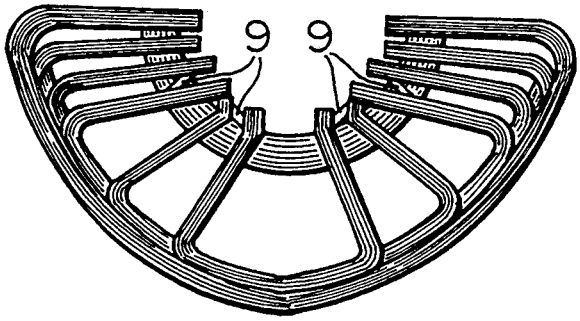
FIG. 6A is a front view illustrating the saddle type deflection coil of the example proposed by the inventor.
Figure 6B:
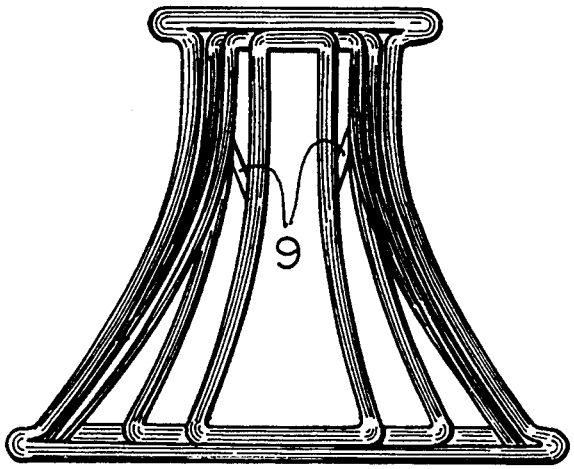
FIG. 6B is a plan view of the saddle type deflection coil of FIG. 6A.
Figure 6C:
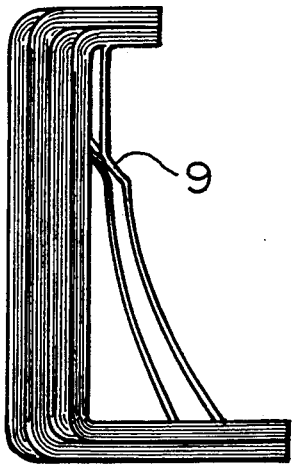
FIG. 6C is a side view of the saddle type deflection coil of FIG. 6A.

Although in the example proposed by the inventor as shown in FIGS. 6A–6C winding operation must be once stopped and then the next winding operation must be started again at the intersection part 9, in the present embodiment there is no need of for the intersection part and hence the wire is capable of being successively wound which greatly speeds up a winding rate.

Figure 13A:
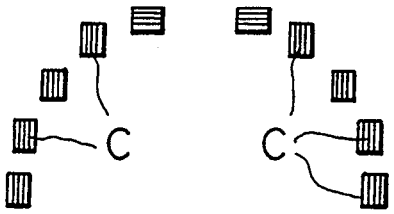
FIG. 13A is a view of an example of lamination of multicore parallel conductor wires of the saddle type deflection coil of the present invention.
Figure 13B:
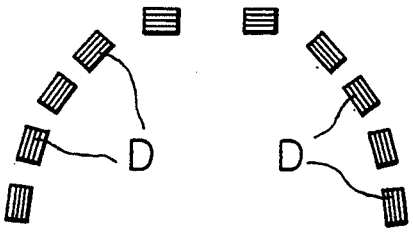
FIG. 13B is a view illustrating another example of lamination of the multicore parallel conductor wires of the saddle type deflection coil of the present invention.

The present invention is not limited to the above embodiment and is capable of taking various modes of embodiments. Referring to FIGS. 13A and 13B, there are illustrated in exemplified manners varieties of laminations of the multicore parallel conductor wires 15. In FIG. 13A, the multicore parallel conductor wires 15 are laminated horizontally at portions thereof designated at C, and in. FIG. 13B the multicore parallel conductor wires 15 are laminated slantingly at portions thereof designated at D. The multicore parallel conductor wires 15 may be laminated in an arbitrary direction without any particular limitation.

Winding molds usable in the present invention may be of any metal mold or any mold of synthetic resin such as plastic and the like.

Although in the above embodiment two winding molds were employed, use may be made of three or more of such winding molds.

Further, after the foregoing saddle type deflection coil is formed, the entire coil may be covered with cast resin which resin is in turn cured to bury the entire coil therewith.

According to the present invention, two coil winding molds are employed and multicore parallel conductor wires are wound in the continuous grooves in the first and second coil winding molds. Such a wire intersection part as in the example proposed by the present inventor therefore becomes unnecessary, and hence a saddle type deflection coil with good dimensional accuracy is ensured without causing the multicore parallel conductor wire to be twisted and displaced.

Further, although in the prior art example winding operation is once stopped and then the next winding operation is started at the wire intersection part, there is not required such wire intersection in the present invention and hence successive winding is ensured to greatly speed up the winding operation.

What is claimed is:

1. A saddle type deflection coil assembly comprising:

an external coil of a saddle configuration formed of a plurality of multicore parallel conductor wires and including a first bent portion at one end thereof, a second bent portion at an opposite end thereof, and an elongated intermediate portion extending from said first bent portion to said second bent portion, said elongated intermediate portion including a plurality of sections constituted of said multicore parallel conductor wires and spaced from each other; and an internal coil of a saddle configuration similar to that of said external coil and formed of a plurality of parallel conductor wires, said internal coil including a first bent portion at one end thereof, a second bent portion at an opposite end thereof, and an elongated intermediate portion extending from said first bent portion to said second bent portion, said elongated intermediate portion including a plurality of sections constituted of said multicore parallel conductor wires and spaced from each other;

said internal core having a width and a length, respectively, smaller than those of said external coil and said internal coil being superimposed on said external coil so as to accurately fit in said external coil and form therewith a saddle configuration of the deflection coil assembly.

2. A saddle type deflection coil assembly according to claim 1, wherein said internal and external coils are bonded within resin.

3. A saddle type deflection coil assembly according to claim 1, wherein cast resin is casted between said coils, and said resin is then cured and fixed.

4. A saddle type deflection coil assembly according to claim 1, wherein a starting end of winding of the external coil is interconnected with a terminating end of winding of the internal coil.

5. A saddle type deflection coil assembly according to claim 1, wherein each of said coils is wound in a separate winding mold which is a metal mold.

6. A saddle type deflection coil assembly according to claim 1, wherein each of said coils is wound in a separate winding mold which is a synthetic resin mold.

7. A saddle type deflection coil assembly according to claim 1, wherein said synthetic resin of each winding mold is plastic.

8. A saddle type deflection coil assembly according to claim 1, which is covered with cast resin over the entire surface thereof and is buried therewith after formation of the coil assembly.

9. A saddle type deflection coil assembly according to claim 1, wherein the first bent portion and the second bent portion of said internal coil are respectively in contact with the first bent portion and the second bent portion of said external coil.

* * * * *